US011248464B2

(12) United States Patent
Xin et al.

(10) Patent No.: US 11,248,464 B2
(45) Date of Patent: Feb. 15, 2022

(54) METHOD OF TREATING TUNNEL COLLAPSE WITH ROOF-CONTACTED SHIELD SUPPORT

(71) Applicants: SHANDONG UNIVERSITY OF SCIENCE AND TECHNOLOGY, Qingdao (CN); CHINA COMMUNICATIONS CONSTRUCTION CO., LTD, Beijing (CN); HEBEI FEIPU ENVIRONMENTAL PROTECTION TECHNOLOGY CO. LTD, Shijiazhuang (CN); QINGDAO WEST COAST RAIL TRANSIT CO., LTD, Qingdao (CN); QINGDAO FIRST MUNICIPAL ENGINEERING CO., LTD, Qingdao (CN)

(72) Inventors: Lin Xin, Qingdao (CN); Shibin Jiang, Qingdao (CN); Fu Yu, Qingdao (CN); Hailiang Wang, Qingdao (CN); Weizhou Li, Qingdao (CN); Quanwei Liu, Qingdao (CN); Wensheng He, Qingdao (CN); Chuan Li, Qingdao (CN); Zhenbiao Wang, Qingdao (CN); Biao Kong, Qingdao (CN); Xiangbao Meng, Qingdao (CN); Yong Zhang, Qingdao (CN); Wenming Zhang, Qingdao (CN); Lide Hou, Qingdao (CN); Jiufang Xiong, Qingdao (CN); Xuexiang Xu, Qingdao (CN); Shuai Wang, Qingdao (CN)

(73) Assignees: SHANDONG UNIVERSITY OF SCIENCE AND TECHNOLOGY, Qingdao (CN); CHINA COMMUNICATIONS CONSTRUCTION CO., LTD., Beijing (CN); HEBEI FEIPU ENVIRONMENTAL PROTECTION TECHNOLOGY CO., LTD., Shijiazhuang (CN); QINGDAO WEST COAST RAIL TRANSIT CO., LTD., Qingdao (CN); QINGDAO FIRST MUNICIPAL ENGINEERING CO., LTD., Qingdao (CN)

( * ) Notice: Subject to any disclaimer, the term of this patent is extended or adjusted under 35 U.S.C. 154(b) by 0 days.

(21) Appl. No.: 17/292,074

(22) PCT Filed: Jul. 20, 2020

(86) PCT No.: PCT/CN2020/102910
§ 371 (c)(1),
(2) Date: May 7, 2021

(87) PCT Pub. No.: WO2021/179508
PCT Pub. Date: Sep. 16, 2021

(65) Prior Publication Data

US 2021/0355828 A1 Nov. 18, 2021

(30) Foreign Application Priority Data

Mar. 11, 2020 (CN) ..... 202010164068.9

(51) Int. Cl.
*E21D 11/00* (2006.01)
*E21D 11/10* (2006.01)
(Continued)

(52) U.S. Cl.
CPC ..... *E21D 11/105* (2013.01); *E21D 11/183* (2013.01); *E21D 15/44* (2013.01); *E21D 19/04* (2013.01)

(58) Field of Classification Search
CPC ..... E21D 23/03; E21D 23/006; E21D 19/04; E21D 11/105; E21D 11/183; E21D 15/45; E21D 15/44
See application file for complete search history.

(56) References Cited

U.S. PATENT DOCUMENTS 3,281,108 A * 10/1966 Lewis ..... E21D 15/45
254/93 R
3,885,397 A * 5/1975 Fujimori ..... E21D 11/40
405/288

(Continued)

FOREIGN PATENT DOCUMENTS

CN 106545351 B 7/2018
CN 104989434 B 8/2018

(Continued)

OTHER PUBLICATIONS

First Search Report issued in corresponding Chinese Application No. 202010164068.9; dated Oct. 15, 2020; State Intellectual Property Office of the P.R. China, Beijing, China, 3 pgs.

(Continued)

*Primary Examiner* — Benjamin F Fiorello
(74) *Attorney, Agent, or Firm* — Hauptman Ham, LLP

(57) ABSTRACT

A method of treating tunnel collapse includes mounting a shield plate, a column, a support column to form a combined support and moving the combined support onto an operation platform, lifting up the combined support, and enabling the height of canopy to be greater than the height of an initial supporting arch. Actively contacting a surface of a collapse cavity by a fixed support column and bearing a load, and lifting a movable support column to the top of the collapse cavity and bearing a load. Mounting an initial supporting arch, and welding the initial supporting arch with the support column. Removing a hydraulic prop after the support column contacting the initial supporting arch is cut off and the load of the shield plate is transferred to a supporting shed. Mounting an exhaust pipe and a filling material pumping pipe, and pumping a filling material into a collapse cavity space.

9 Claims, 7 Drawing Sheets

(51) Int. Cl.
*E21D 15/44* (2006.01)
*E21D 11/18* (2006.01)
*E21D 19/04* (2006.01)

(56) References Cited

U.S. PATENT DOCUMENTS 3,903,707 A * 9/1975 Foik ..... E21D 9/0692
405/142
3,964,265 A * 6/1976 Jamison ..... E21C 27/00
405/294
3,978,675 A * 9/1976 Jenkins ..... E21D 9/10
405/289
4,065,929 A * 1/1978 Simpson ..... E21D 23/0017
299/11
4,189,257 A * 2/1980 Nakajima ..... E21D 19/02
405/291
4,190,292 A * 2/1980 Johannes ..... E21D 11/15
299/12
2020/0095863 A1* 3/2020 Dodgson ..... E21D 23/0004

FOREIGN PATENT DOCUMENTS

CN 111365043 A 7/2020
CN 111365044 A 7/2020
EP 1719876 A1 * 11/2006 ..... E21D 23/0091

OTHER PUBLICATIONS

Notice of Grant issued in corresponding Chinese Application No. 202010164068.9; dated Oct. 22, 2020; State Intellectual Property Office of the P.R. China, Beijing, China, 3 pgs.
International Search Report issued in corresponding International Application No. PCT/CN2020/102910; dated Sep. 30, 2020; State Intellectual Property Office of the P.R. China, Beijing, China, 9 pgs.
Written Opinion issued in corresponding International Application No. PCT/CN2020/102910; dated Sep. 30, 2020; State Intellectual Property Office of the P.R. China, Beijing, China, 9 pgs.

* cited by examiner

A-A

METHOD OF TREATING TUNNEL COLLAPSE WITH ROOF-CONTACTED SHIELD SUPPORT

RELATED APPLICATIONS

The present application is a U.S. National Phase of International Application Number PCT/CN2020/102910, filed Jul. 20, 2020, and claims the priority of Chinese Application No. 202010164068.9, filed Mar. 11, 2020.

TECHNICAL FIELD

The present disclosure relates to the field of tunnel and underground engineering operation technologies, and in particular to a method of treating tunnel collapse with a roof-contacted shield support.

BACKGROUND

At present, common methods of treating tunnel collapse accidents mainly include a pipe shed method, a backfilling method, a cover-arch method, a small duct grouting method, a secondary lining reinforcement method, and the like. In the pipe shed method, a borehole parallel to a tunnel axis is drilled along an excavation contour line and then steel pipes with different diameters are inserted so as to form a steel pipe shed. In the backfilling method, drilling and grouting or filling material backfilling are performed from a ground surface or from inside a tunnel above a collapse cavity. In the small duct grouting method, small ducts with grouting holes are driven toward a tunnel face at a certain elevation angle along an outer contour line of the tunnel before a collapse body is excavated, so as to fully fill fissures of surrounding rock by grouting and form a combination body with certain thickness, thereby ensuring a stable tunnel contour.

Patent documents in the prior art are described below.

The patent document 1 provides a method of treating a collapse of a tunneling working face using a penetration pipe combination arch (publication number: CN104989434B), which specifically includes: erecting a ring arch in a safe region, erecting a segmented supporting arch under the protection of steel pipes to realize the technical effect of safe, fast and effective treatment of collapse. However, the following problems still exist: (1) the manual operation of the collapse treatment process has high labor intensity and low working efficiency; (2) the operators in the collapse section are directly exposed under the collapse when erecting the segmented supporting arch in spite of protection of the steel pipes; especially in step 2, an arch top section of the segmented supporting arch in the collapse region will be lifted to higher than the contour line of an initial support of tunnel, and the operators have to be exposed under the collapse cavity, resulting in large potential safety hazards.

The patent document 2 provides an emergency treatment method for collapse of a tunneling working face (publication number: CN106545351B), which specifically includes: continuously supporting two arch beams using a single hydraulic prop in a safe section, forming a bearing point by use of two arch beams supported on the arch top of the safe section, with a position of a collapse region working face into which a wedge beam is wedged as another bearing point. Two bearing points support the wedge beam and a bearing body is placed on the wedge beam, so as to effectively treat collapse. The following problems still exist: (1) low working efficiency: although the working efficiency of the safe section is improved by the single hydraulic prop, manual operations are still required for the key links of the collapse section, thereby resulting in no improvement of the working efficiency; (2) existence of potential safety hazards: although the operators are protected by the wedge beam, the operators still have to be exposed under the collapse cavity when laying the bearing body such as a sleeper, bringing a large potential safety hazard; (3) limitation of effectiveness: the surrounding rocks of the working face of the collapse section are soft rocks, resulting in instability of bearing points; or, when the surrounding rocks of the working face of the collapse section are hard rocks, the wedge top beam cannot be wedged into the surrounding rocks of the working face to form a bearing point. In these two circumstances, the technical solution recorded herein cannot be achieved, and thus the anticipated technical effect cannot be realized.

In addition, when the single hydraulic prop is used, if roof contact cannot be carried out in time, a supporting force cannot be applied to the roof; when the roof of the collapse cavity collapses, hydraulic oil of the single hydraulic prop cannot be discharged in time when an instantaneous pressure of the collapse suddenly increases and acts on the single hydraulic prop, thereby resulting in a cylinder explosion accident. That is, the oil cylinder of the single hydraulic prop instantaneously deforms or cracks due to an impact pressure. When the single hydraulic prop is used, the stroke of the single hydraulic prop cannot satisfy requirements of the lifting height of the shield plate; especially when the collapse cavity is large in depth, active supporting cannot be applied to the surface of the collapse cavity.

SUMMARY

To solve the problems in the existing collapse treatments, the present disclosure provides a method of treating tunnel collapse with a roof-contacted shield support. The method solves the technical problems: the lifting height of the single hydraulic prop is insufficient when the collapse cavity is high, active supporting cannot be applied to the surface of the collapse cavity, the load at the top of the collapse cavity is transferred from the single hydraulic prop to an initial supporting arch and the cylinder explosion problem is likely to occur in a case of a sudden collapse at a collapse position. The specific technical solution is described below.

A method of treating tunnel collapse with a roof-contacted shield support includes the following steps.

At step 1, a column, a fixed support column, a movable support column, a transverse canopy and a longitudinal canopy are fixedly mounted on a shield plate to form a combined support, where an upper connection plate of the movable support column is fixed on an upper surface of the shield plate.

At step 2, gravels below a collapse cavity are leveled to form an operation platform, and the combined support is moved to be above the operation platform.

At step 3, a single hydraulic prop is transported to the operation platform, then erected, and lifted up to enable each single hydraulic prop to be fitted with the transverse canopy or the longitudinal canopy.

At step 4, the single hydraulic prop is further lifted to enable heights of the transverse canopy, the longitudinal canopy, the shield plate and a guide pipe to be greater than a mounting height of an initial supporting arch; after the fixed support column contacts a surface of the collapse cavity, a bearing capacity of the single hydraulic prop is slowly increased to a rated working resistance, and then, a liquid supply valve is locked.

At step 5, a single hydraulic prop is disposed below the movable support pillar to fit a top cover of the single hydraulic prop with a lower connection plate of the movable support column, so as to continue lifting up the single hydraulic prop below the movable support; and after an upper connection plate of the movable support column contacts the surface of the collapse cavity, a bearing capacity of the single hydraulic prop is slowly increased to the rated working resistance, and then, a liquid supply valve is locked.

At step 6, the initial supporting arch is erected below the shield plate, and then connected to form an initial supporting shed.

At step 7, intersection points between the initial supporting arch and the column/the movable support column is fixedly welded, and the parts of the column and the movable support column within a contour of the initial supporting arch are cut off.

At step 8, after the single hydraulic props are removed, a filling material pumping pipe is inserted into a reserved concrete hole of the shield plate, an exhaust pipe is inserted into a reserved air hole, and a metal net is hung on the initial supporting arch.

At step 9, fast-setting concrete is sprayed to the initial supporting arch, a filling material is injected into the collapse cavity through the filling material pumping pipe, and air in the collapse cavity is discharged through the exhaust pipe until the collapse cavity is filled up with the filling material.

Preferably, at step 1, the transverse canopy and the longitudinal canopy of the combined support are fixed on a lower surface of the shield plate, the fixed support column is fixed on an upper surface of the shield plate, the movable support column is penetrated through a guide hole on the shield plate and overlapped with the shield plate, and the column is fixedly supported on the lower surface of the shield plate.

Further preferably, one or more movable support columns are disposed on the shield plate, and the movable support columns, the guide holes and the guide pipes are correspondingly arranged; the contour size of the lower connection plate of the movable support column is less than that of an inner wall of the guide pipe, and a toothed groove mated with the top cover of the single hydraulic prop is further disposed on the lower connection plate; the contour size of the upper connection plate of the movable support column is greater than that of the guide hole, and the upper connection plate is fixed on the upper surface of the shield plate by bolts.

Further preferably, at step 2, the combined support is moved to be above the operation platform by using an excavator; or, the combined support is fixed on a motor vehicle which then moves onto the operation platform to complete the lifting-up of the combined support and the mounting of the initial supporting arch on the motor vehicle.

Further preferably, at step 3, an upper end of the single hydraulic prop is supported on the transverse canopy or the longitudinal canopy, a lower end of the single hydraulic prop is fixed on the ground by a prop shoe, and the prop shoe is fixedly connected by a rigid structure.

Further preferably, at step 4, after the fixed support column contacts the surface of the collapse cavity, the single hydraulic prop is adjusted, and the fixed support column actively provides a supporting force for the collapse cavity; at step 5, after the movable support column contacts the surface of the collapse cavity, the single hydraulic prop is adjusted, and the movable support column actively provides a supporting force for the collapse cavity.

Further preferably, at step 6, when the single hydraulic prop occupies a mounting position of the initial supporting arch, an alternative single hydraulic prop is firstly erected at a position adjacent to the single hydraulic prop, and then, the single hydraulic prop occupying the mounting position of the initial supporting arch is removed.

Further preferably, after step 7 is completed, the load of the shield plate is transferred from the single hydraulic prop to the initial supporting arch.

Further preferably, at step 8, the exhaust pipe is protruded into the top of the collapse cavity, and the height of an outlet of the filling material pumping pipe is less than that of a port of the exhaust pipe; at step 9, fast-hardening concrete is sprayed onto the initial supporting arch to form a closed shell.

The method of treating tunnel collapse with a roof-contacted shield support according to the present disclosure has the following beneficial effects.

(1) The method provides a safe operation space for operators below the collapse cavity with the shield plate of the combined support. The fixed support column and the movable support column can contact a roof in time and effectively support the surface of the collapse cavity. Therefore, the probability that the collapse cavity continues collapsing may be reduced, and the cylinder explosion accident of the single hydraulic prop may also be avoided. The single hydraulic prop lifts up the shield plate, helping the erection of the initial supporting arch and realizing smooth transition of the load of the shield plate from the single hydraulic prop to the initial supporting arch.

In the method of treating tunnel collapse, the operation of each step is carried out in the safe operation space, so that the method is particularly applicable to the treatment for an initial tunnel collapse having a relatively stable collapse cavity and a relatively flat collapse cavity surface. The method actively provides a supporting force by use of effective cooperation of the single hydraulic prop and the support columns, ensuring the supporting safety. In the method, the mounting of the initial supporting arch is convenient, the structure of each part of the roof-contacted shield support will not invade into the operation space of the initial supporting arch, and the erected initial supporting arch will also not invade into the operation space of secondary lining, thereby avoiding the removal operation of the initial supporting arch during the subsequent secondary lining operation. In addition, effective grouting treatment is also carried out for the collapse cavity space by the method, thereby ensuring the safety of the supporting structure.

In addition, the method also has advantages of safe operation below the collapse cavity, high mechanization, low labor intensity, high operation efficiency, and the like.

Figure 1:
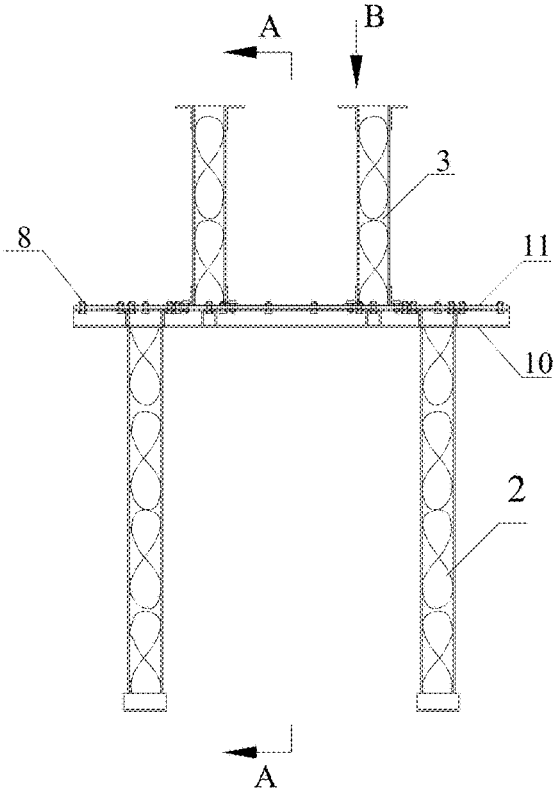
FIG. 1 is a structural diagram of mounting of a combined support.
Figure 2:
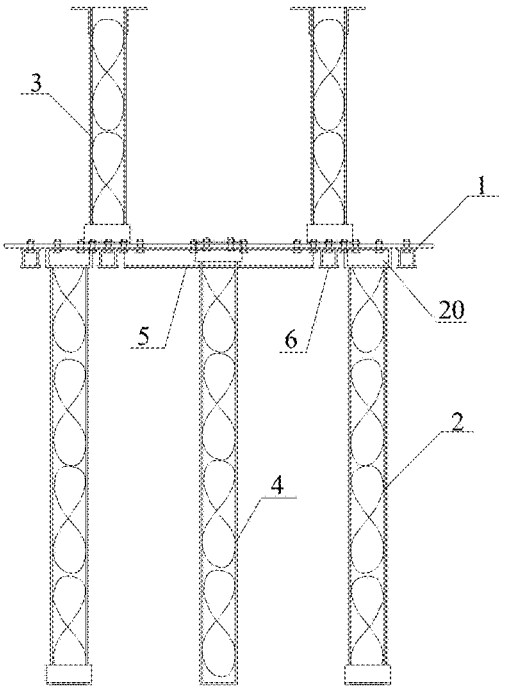
FIG. 2 is a sectional view taken along A-A in FIG. 1.
Figure 3:
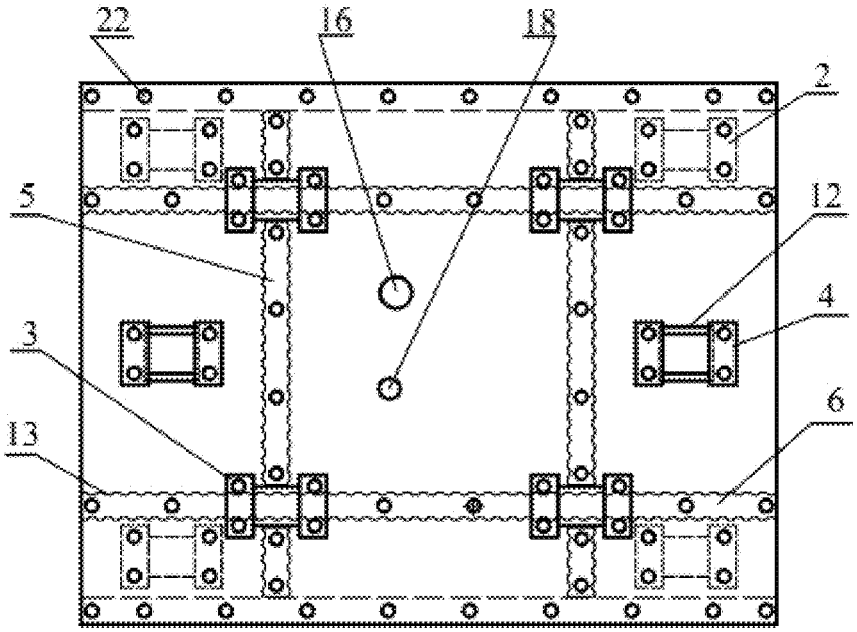
FIG. 3 is a view of direction B in FIG. 1.
Figure 4:
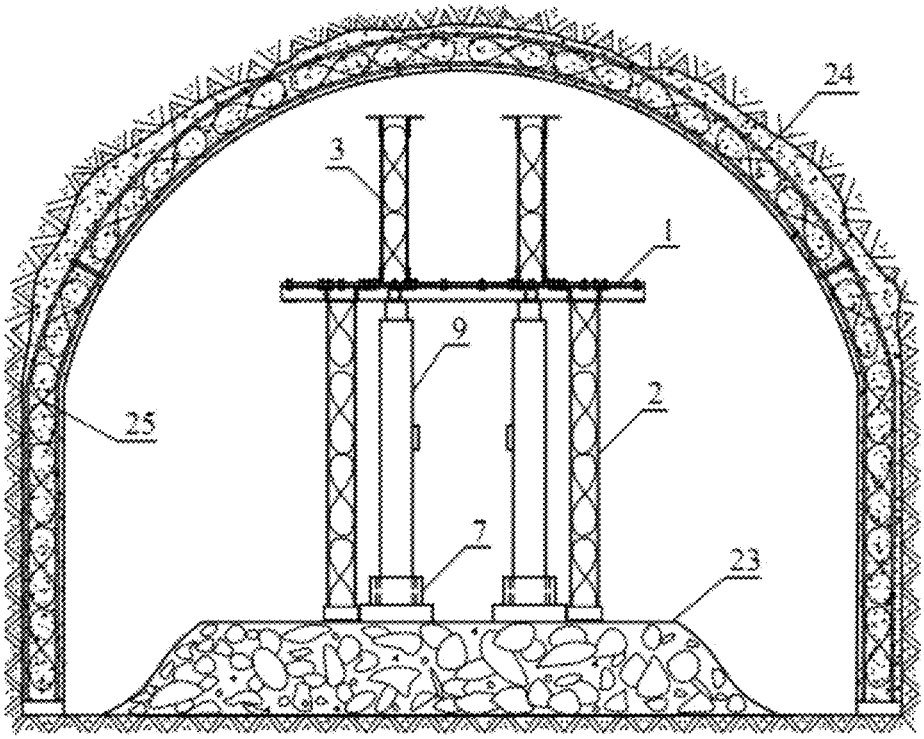
FIG. 4 is a schematic diagram of mounting of a combined support.
Figure 5:
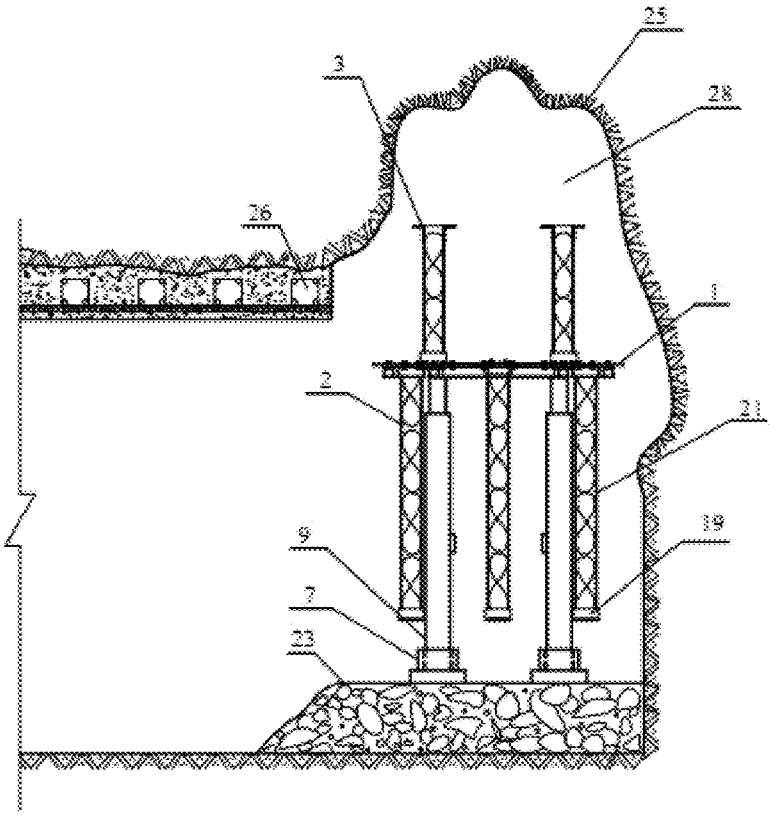
FIG. 5 is a schematic diagram of a process of lifting up a single hydraulic prop.
Figure 6:
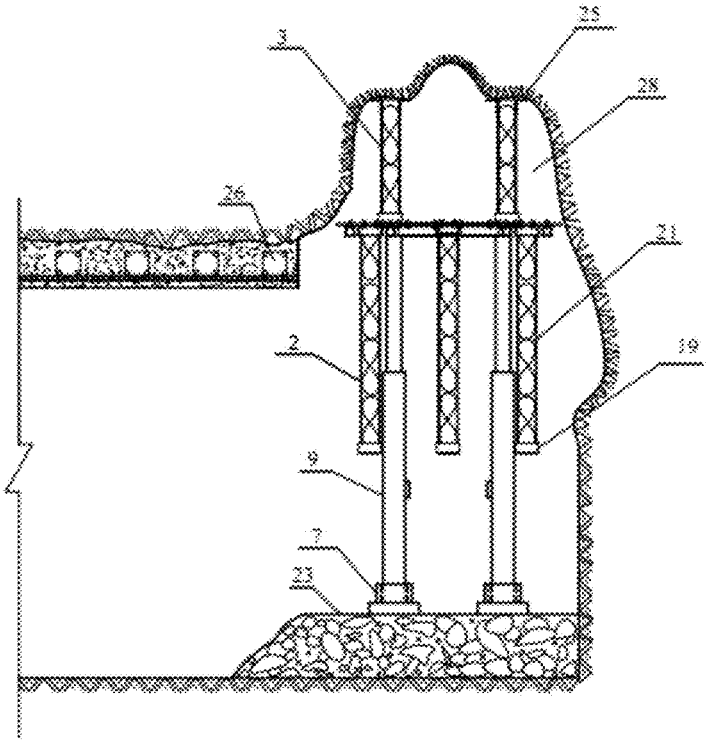
FIG. 6 is a schematic diagram of roof contact of a fixed support column.
Figure 7:
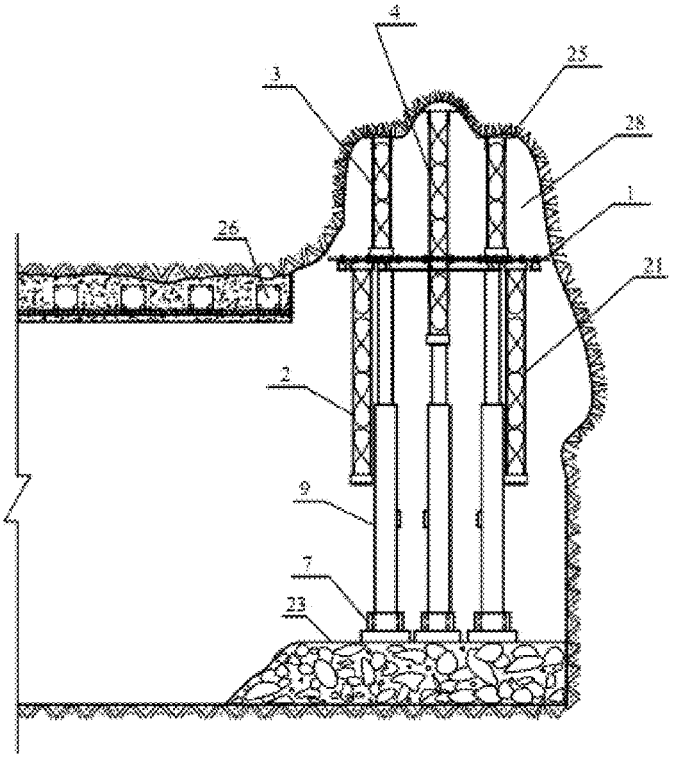
FIG. 7 is a schematic diagram of roof contact of a movable support column.
Figure 8:
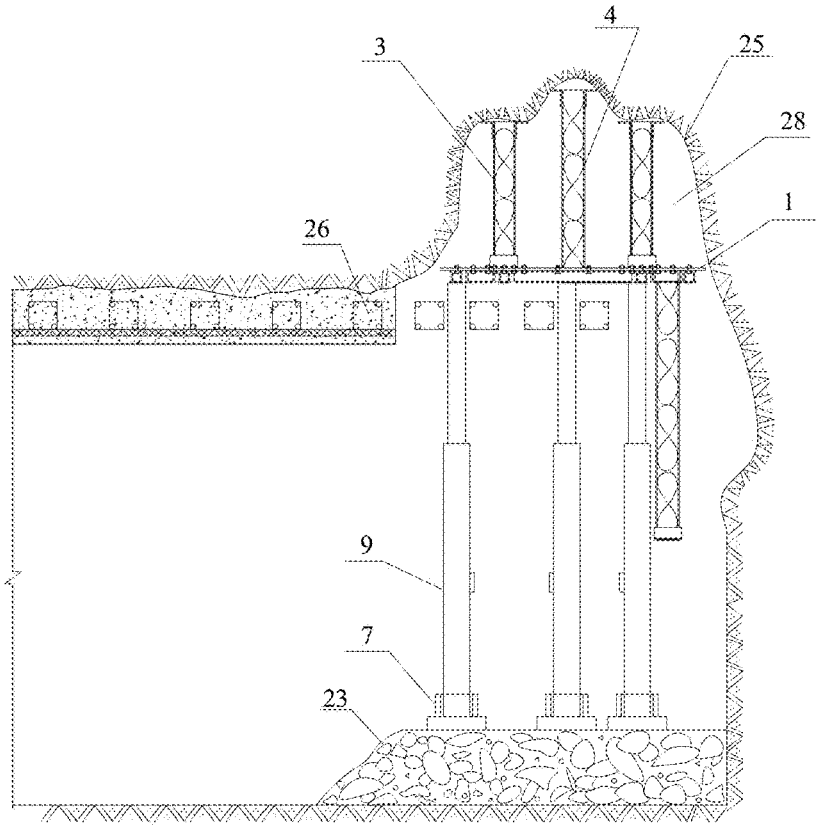
FIG. 8 is a schematic diagram of mounting of an initial supporting arch.
Figure 9:
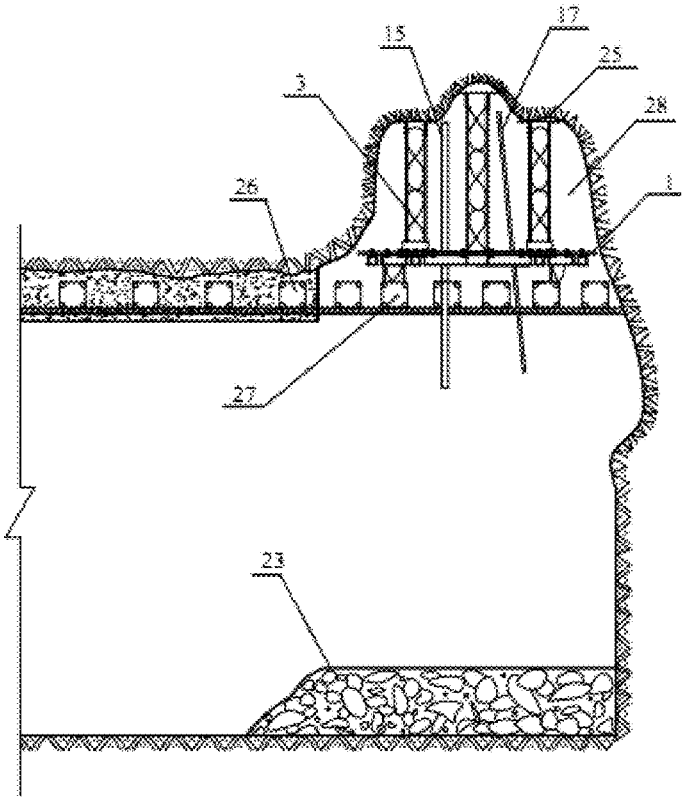
FIG. 9 is a schematic diagram after removal of a single hydraulic prop.
Figure 10:
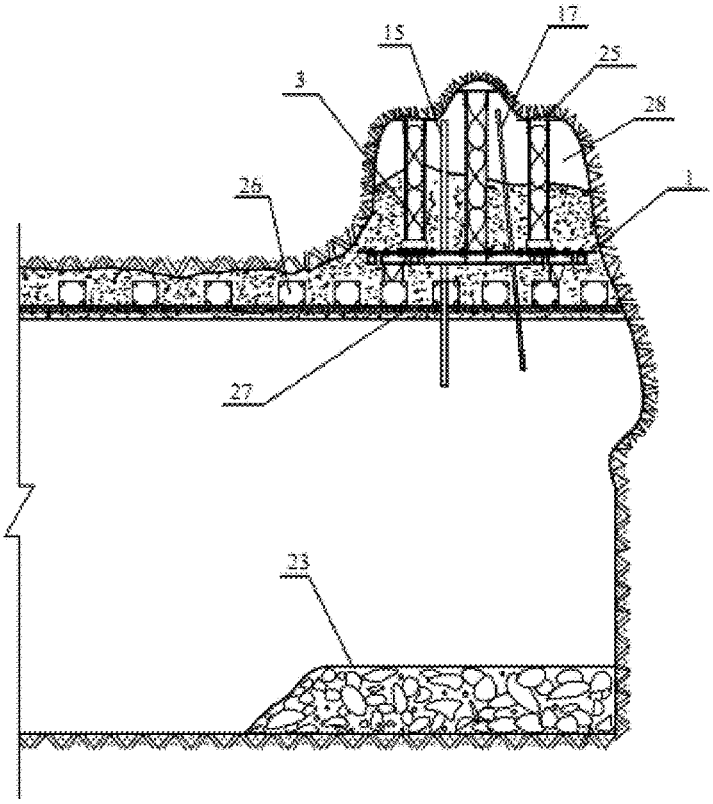
FIG. 10 is a schematic diagram of a collapse cavity filled with a filling material.
Figure 11:
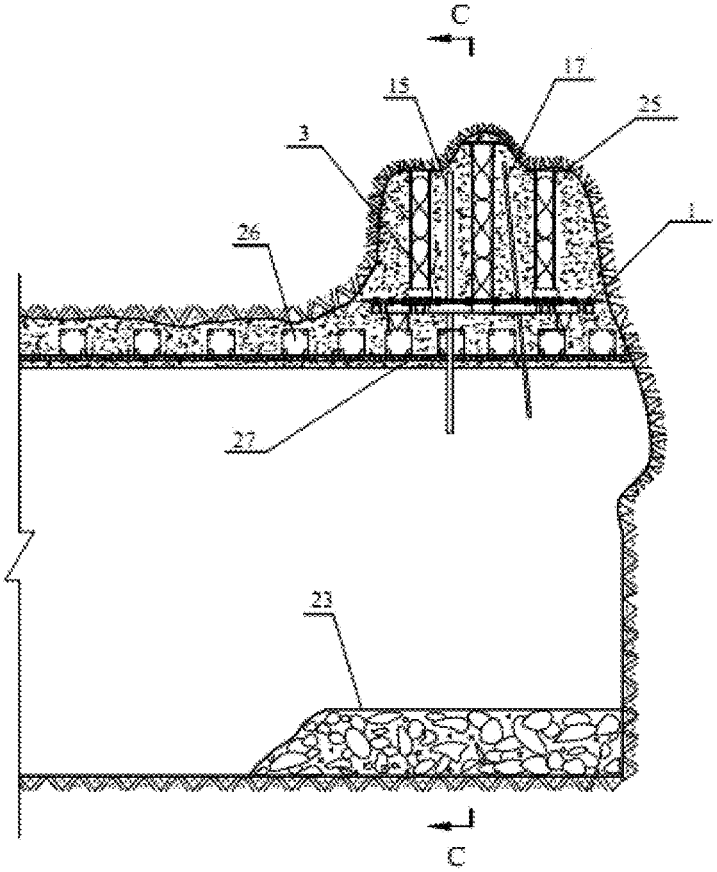
FIG. 11 is a schematic diagram after treatment of a collapse.
Figure 12:
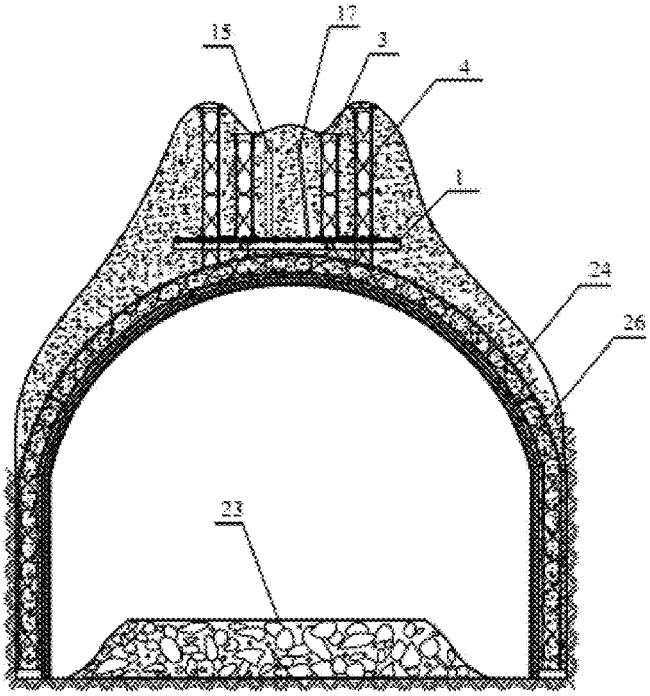
FIG. 12 is a schematic diagram of section C-C in FIG. 11.

Numerals of the drawings are described as follows: 1—shield plate; 2—column; 3—fixed support column; 4—movable support column; 5—transverse canopy; 6—longitudinal canopy; 7—prop shoe; 8—bolt; 9—single hydraulic prop; 10—lower surface; 11—upper surface; 12—guide hole; 13—toothed groove; 14—guide pipe; 15—filling material pumping pipe; 16—reserved concrete hole; 17—exhaust pipe; 18—reserved air hole; 19—lower connection plate; 20—upper connection plate; 21—column body; 22—screw hole; 23—operation platform; 24—initial supporting arch outer contour line; 25—collapse cavity surface; 26—initial supporting arch; 27—initial supporting shed frame; and 28—collapse cavity.

DETAILED DESCRIPTION OF THE EMBODIMENTS

As shown in FIGS. 1-14, a method of treating tunnel collapse with a roof-contacted shield support according to the present disclosure is described with the following specific examples.

A method of treating tunnel collapse with a roof-contacted shield support is mainly applied to the treatment of an initial tunnel collapse having a relatively flat surface of the collapse cavity 28 and ease of roof contact. The method includes the following specific steps.

At step 1, a column 2, a fixed support column 3, a movable support column 4, a transverse canopy 5 and a longitudinal canopy 6 are fixedly mounted on a shield plate 1 to form a combined support, where an upper connection plate of the movable support column 4 is fixed on an upper surface 11 of the shield plate.

Specifically, a guide hole 12, a reserved concrete hole 16 and a reserved air hole 18 are firstly opened at appropriate positions of the selected shield plate 1 which generally is made of a steel plate material; then, the column 2, the fixed support column 3, the transverse canopy 5 and the longitudinal canopy 6 are fixedly mounted on the shield plate 1 respectively; next, the movable support column 4 is temporarily fixedly mounted on the shield plate 1 by bolts and nuts, where the nuts are disposed on a lower side surface of the shield plate 1. The column 2 and the fixed support column 3 may be made of profile steels such as steel pipes and I-steel or grids formed by welding steel bars; the transverse canopy 5 and the longitudinal canopy 6 may be a mining-specific metal top beam.

The combined support is a part of the roof-contacted shield support. The roof-contacted shield support further includes a single hydraulic prop 9, a filling material pumping pipe 15 and an exhaust pipe 17. The transverse canopy 5 and the longitudinal canopy 6 are fixed on a lower surface of the shield plate 1 to improve rigidness and a bearing capacity of the shield plate 1. The column 2 is further disposed below the shield plate to support the plane where the shield plate 1 is located. The fixed support column 3 is fixed on the upper surface 11 of the shield plate. The movable support column 4 is penetrated through the guide hole 12 on the shield plate 1 and overlapped on the shield plate 1, and may extend toward above the shield plate 1. In a case of use, the fixed support column 3 and the movable support column 4 actively contact a surface 25 of the collapse cavity and bear a load, that is, the fixed support column 3 actively contacts the roof and bears the load under the lifting-up action of the single hydraulic prop 9, then another single hydraulic prop 9 is disposed to lift up the movable support column 4 to actively contact the roof and bear the load, thereby improving the roof contacting effect. The column 2, the fixed support column 3 and the movable support column 4 each include an upper connection plate 20, a lower connection plate 19 and a column body 21, and have similar structure. A screw hole 22 is arranged on both the upper connection plate 20 and the lower connection plate 19 to facilitate mounting and dismounting; other easy-to-dismount connection pieces may also be used. In addition, components requiring no dismounting may be fixed by welding. For example, fixed welding may be used for the extension process of the movable support column 4.

At step 2, gravels below the collapse cavity 28 are leveled to form an operation platform 23, and the combined support is moved to be above the operation platform 23. Specifically, the gravels may be leveled by using an excavator, and then, the combined support may be moved to be above the operation platform 23 by using the excavator. Optionally, the combined support may be fixed on a motor vehicle which moves onto the operation platform 23 so as to complete the lifting-up of the support and the mounting of the initial supporting arch on the motor vehicle.

At step 3, a single hydraulic prop 9 is transported onto the operation platform 23, and then erected, and lifted up to fit each single hydraulic prop 9 with the transverse canopy 5 or the longitudinal canopy 6. An upper end of the single hydraulic prop 9 is supported on the transverse canopy 5 or the longitudinal canopy 6, and a lower end of the single hydraulic prop 9 is fixed on the ground by a prop shoe 7. The minimum height of the single hydraulic prop 9 after retraction is less than the height of the column 2, and the maximum height of the single hydraulic prop 9 after extension is greater than the height of the column 2.

Specifically, the single hydraulic prop 9 may be moved to be below the combined support under the protection of bucket of the excavator, and a pull rod may be further disposed between the single hydraulic props 9 for combination connection to ensure the overall stability. The number of single hydraulic props 9 used may be designed according to the scope of the collapse cavity 28 and the size of the combined support. Further, the mounting position of the single hydraulic prop 9 may be determined according to actual site conditions, and a prop shoe 7 is mounted on each single hydraulic prop 9 one by one. The prop shoe 7 may be aligned with the transverse canopy 5 or the longitudinal canopy 6 so that the single hydraulic prop 9 can be fitted with a toothed groove 13 of the transverse canopy 5 or the longitudinal canopy 6 after lifting, thereby ensuring firm fitting. The prop shoe may also be fixedly connected by a rigid structure which may specifically be a seat or a connection groove made of a steel material. The prop shoe is directly fixed in the seat or the connection groove. In this case, the stability of the rigid structure may be further guaranteed by increasing a contact area with the platform, reducing center of gravity or increasing weight, or the like.

At step 4, the lifting-up of the single hydraulic prop 9 is continued to enable heights of the transverse canopy 5, the longitudinal canopy 6, the shield plate 1 and a guide pipe 14 to be greater than the mounting height of an outer contour line 24 of the initial supporting arch, that is, the lifting-up heights of the transverse canopy 5, the longitudinal canopy 6 and the guide pipe 14 of the combined support are all greater than the height of the outer contour line 24 of the initial supporting arch. After the fixed support column 3 contacts the surface 25 of the collapse cavity, the bearing capacity of the single hydraulic prop 9 is slowly increased to a rated working resistance, and then, a liquid supply valve is locked.

The initial supporting arch 26 is a grid support for initial tunnel supporting, which is formed by processing metal profile steels or welding steel bars.

At step 5, a single hydraulic prop 9 is disposed below the movable support column 4 and bolts 8 connecting the movable support column 4 and the shield plate 1 are removed to fit a top cover of the single hydraulic prop with the lower connection plate 19 of the movable support column 4, so as to continue lifting the single hydraulic prop 9 below the movable support column 4. When the upper connection plate of the movable support 4 contacts the surface 25 of the collapse cavity, a bearing capacity of the single hydraulic prop 9 is slowly increased to a rated working resistance, and then, a liquid supply valve is locked.

Figure 13:
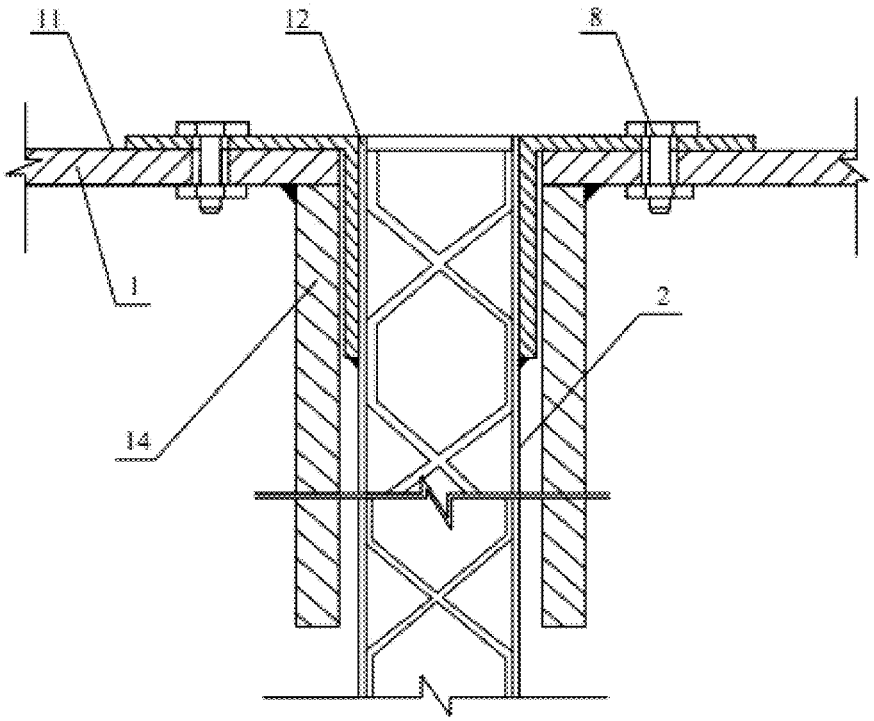
FIG. 13 is a schematic diagram of an assembly structure of a movable support column.
Figure 14:
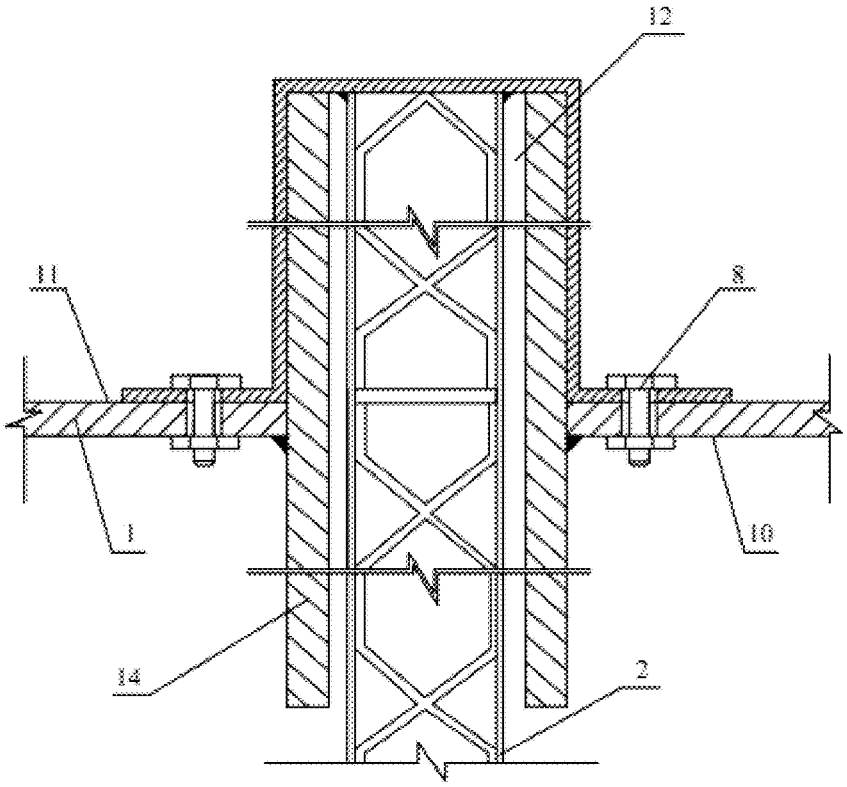
FIG. 14 is a schematic diagram of another assembly structure of a movable support column.

The shield plate 1 and the movable support column 4 have the following specific structures. The guide pipe is disposed inside the guide hole 12 of the shield plate to guide and limit a lifting-up direction of the movable support column 4, thereby preventing the movable support column 4 from falling sidewise or inclining during lifting-up, and facilitating up and down movement of the movable support column 4. The movable support column 4 moves along the guide pipe 14 in cooperation with the guide pipe 14, and is sleeved into the guide pipe 14. Each movable support column 4 includes an upper connection plate 20, a lower connection plate 19 and a column body 21, and a screw hole 22 is arranged on both the upper connection plate 20 and the lower connection plate 19. The contour size of the lower connection plate 19 of the movable support column 4 is smaller than that of an inner wall of the guide pipe 14, and a toothed groove 13 mated with the top cover of the single hydraulic prop 9 is further disposed on the lower connection plate 19. The contour size of the upper connection plate of the movable support column 4 is greater than that of the guide hole 12, and the upper connection plate of the movable support column 4 is fixed on the upper surface 11 of the shield plate by bolts 8. The movable support column 4 is overlapped on the shield plate 1 in a connection manner as shown in FIG. 13 or FIG. 14. In the example of FIG. 13, an end of the guide pipe 14 is fixed on a lower side surface of the shield plate 1 by welding, the upper connection plate of the movable support column 4 and the column body 21 are fixed by welding, and a screw hole 22 is disposed on the upper connection plate to mate with the screw hole on the shield plate 1. When the combined support is mounted, the movable support column 4 is fixed by bolts 8, and may move upward after the bolts 8 are removed. In the example of FIG. 14, a middle portion of the guide pipe 14 is fixed on the shield plate 1 by welding, the upper connection plate of the movable support column 4 and the column body 21 are fixed by welding, an insertion groove is formed between the upper connection plate and the column body, and the guide pipe 14 is inserted into a space between the upper connection plate and the column body. In addition, one or more movable support columns 4 may be further disposed on the shield plate 1 or disposed according to the shape of the collapse cavity 28, and the movable support column 4, the guide hole 12 and the guide pipe 14 are correspondingly arranged in number and structure. The fixed support column 3 may be arranged at both sides of the movable support column 4, or may be flexibly disposed according to the shape of the collapse cavity 28; a plurality of fixed support columns 3 may be disposed on the shield plate 1, and the fixed support column 3 may be fixed on the shield plate 1 through the screw hole of the lower connection plate 19 or fixed on the shield plate 1 by welding. Generally, the fixed support column 3 is perpendicular to the shield plate 1, or may form an included angle with the shield plate 1 to adapt to different collapse cavities.

At step 6, the initial supporting arch 26 is erected below the shield plate 1 and then connected with the initial supporting arch 26 to form an initial supporting shed 27. When the initial supporting shed is disposed at a position adjacent to the collapse cavity 28 in the tunnel, the initial supporting arch newly-erected below the shield plate 1 is fixedly connected together with original supporting structures such as the initial supporting shed, where the original supporting structures further include an initial supporting arch, an anchor bolt, an anchor cable and an anchor net, and the like.

The initial supporting arch newly-erected below the shield plate 1 is fixedly connected together with the original initial supporting shed by using metal materials such as steel bars and profile steels, so as to form the stable initial supporting shed.

In addition, when the single hydraulic prop 9 occupies the mounting position of the initial supporting arch, an alternative single hydraulic prop is firstly erected at a position adjacent to the single hydraulic prop, and then, the single hydraulic prop 9 occupying the mounting position of the initial supporting arch is removed.

At step 7, intersection points of the initial supporting arch 26 and the column 2/the movable support column 4 is fixed by welding, and the parts of the column 2 and the movable support column 4 in the contour of the initial supporting arch are cut off.

After the operation of step 7 is completed, the supporting of the collapse zone is smoothly transferred from the combined support and the single hydraulic prop to the initial supporting shed., that is, the load of the shield plate is transferred from the single hydraulic prop 9 to the initial supporting shed, where the load of the shield plate includes dead-weight of the shield plate structure and a pressure transmitted to the shield plate 1 from above.

At step 8, after the single hydraulic props 9 are removed, a filling material pumping pipe 15 is inserted into a reserved concrete hole 16 of the shield plate, an exhaust pipe 17 is inserted into a reserved air hole 18, and a metal net is hung on the initial supporting arch 26. The slurry discharge height of the filling material pumping pipe 15 should be close to the top of the collapse cavity as possible, an anti-clogging top cover may be disposed at an end of the exhaust pipe 17, and the exhaust pipe 17 will be protruded to furthest above the collapse cavity as possible.

At step 9, fast-setting concrete is sprayed to the initial supporting arch 26, a filling material is injected into the collapse cavity through the filling material pumping pipe 15, and air in the collapse cavity is discharged through the exhaust pipe 17 until the collapse cavity is filled up with the filling material.

Specifically, the fast-setting concrete is firstly sprayed to the initial supporting arch 26 in the tunnel to form a closed shell, and then, the filling material is injected into the collapse cavity 28 through the filling material pumping pipe 15, and the air in the collapse cavity 28 is emptied through the exhaust pipe 17 during the pumping. The filling material may be an organic or inorganic filling material such as concrete, foamed concrete, Marithan, or the like.

In the method of treating tunnel collapse, the operation of each step is carried out in a safe operation space, so that the method is particularly applicable to the collapse treatment of an initial tunnel collapse having a relatively flat surface of the collapse cavity 28 and ease of roof contact. The method active provides the supporting force by cooperation of the single hydraulic props and the support columns to ensure the supporting safety. The mounting of the initial supporting arch is convenient, the structure of each part of the roof-contacted shield support will not invade into the operation space of initial supporting, and the erected initial supporting arch will also not invade into the operation space of secondary lining operation, thereby avoiding the removal operation of the initial supporting arch during the subsequent secondary lining operation. In addition, the method also improves the safety and mechanization level of the operation below the collapse cavity.

Certainly, the foregoing descriptions are not intended to limit the present disclosure, and the present disclosure is also not limited to the above examples. Changes, modifications, additions or substitutions made by persons skilled in the art within the scope of essence of the present disclosure shall also be encompassed in the scope of protection of the present disclosure.

The invention claimed is:

1. A method of treating tunnel collapse with a roof-contacted shield support, comprising the following steps:

at step 1, fixedly mounting a column, a fixed support column, a movable support column, a transverse canopy and a longitudinal canopy on a shield plate to form a combined support, wherein an upper connection plate of the movable support column is fixed on an upper surface of the shield plate;

at step 2, leveling gravels below a collapse cavity to form an operation platform, and moving the combined support to be above the operation platform;

at step 3, transporting a single hydraulic prop to the operation platform, erecting and lifting up the single hydraulic prop to fit each single hydraulic prop with the transverse canopy or the longitudinal canopy;

at step 4, continuing lifting up the single hydraulic prop to enable heights of the transverse canopy, the longitudinal canopy, the shield plate and a guide pipe to be greater than a mounting height of an initial supporting arch; after the fixed support column contacts a surface of the collapse cavity, slowly increasing a bearing capacity of the single hydraulic prop to a rated working resistance, and then, locking a liquid supply valve;

at step 5, disposing a single hydraulic prop below the movable support column to fit a top cover of the single hydraulic prop with a lower connection plate of the movable support column, so as to continue lifting up the single hydraulic prop below the movable support column; after the upper connection plate of the movable support column contacts the surface of the collapse cavity, slowly increasing a bearing capacity of the single hydraulic prop to the a rated working resistance, and then, locking a liquid supply valve;

at step 6, erecting the initial supporting arch below the shield plate, and then connecting the initial supporting arches to form an initial supporting shed;

at step 7, fixing intersection points of the initial supporting arch and the column/the movable support column by welding, and cutting off the parts of the column and the movable support column within a contour of the initial supporting arch;

at step 8, after the single hydraulic props are removed, inserting a filling material pumping pipe into a reserved concrete hole of the shield plate, inserting an exhaust pipe into a reserved air hole, and hanging a metal net on the initial supporting arch; and at step 9, spraying fast-setting concrete to the initial supporting arch, injecting a filling material into the collapse cavity through the filling material pumping pipe, and discharging air in the collapse cavity through the exhaust pipe until the collapse cavity is filled up with the filling material.

2. The method of treating tunnel collapse with a roof-contacted shield support according to claim 1, wherein at step 1, the transverse canopy and the longitudinal canopy of the combined support are fixed on a lower surface of the shield plate, the fixed support column is fixed on the upper surface of the shield plate, the movable support column is penetrated through a guide hole on the shield plate and overlapped on the shield plate, and the column is fixedly supported on the lower surface of the shield plate.

3. The method of treating tunnel collapse with a roof-contacted shield support according to claim 2, wherein one or more movable support columns are disposed on the shield plate, and the movable support column, the guide hole and the guide pipe are correspondingly arranged;

the contour size of the lower connection plate of the movable support column is less than a contour size of an inner wall of the guide pipe, and a toothed groove mated with a top cover of the single hydraulic prop is further disposed on the lower connection plate; a contour size of the upper connection plate of the movable support column is greater than a contour size of the guide hole, and the upper connection plate is fixed on the upper surface of the shield plate by bolts.

4. The method of treating tunnel collapse with a roof-contacted shield support according to claim 1, wherein at step 2, the combined support is moved to be above the operation platform by using an excavator; or, the combined support is fixed on a motor vehicle which then moves onto the operation platform to complete the lifting-up of the combined support and the mounting of the initial supporting arch on the motor vehicle.

5. The method of treating tunnel collapse with a roof-contacted shield support according to claim 1, wherein at step 3, an upper end of the single hydraulic prop is supported on the transverse canopy or the longitudinal canopy, and a lower end of the single hydraulic prop is fixed on the ground by a prop shoe; the prop shoe is fixedly connected by a rigid structure.

6. The method of treating tunnel collapse with a roof-contacted shield support according to claim 1, wherein at step 4, after the fixed support column contacts the surface of the collapse cavity, the single hydraulic prop is adjusted and the fixed support column actively provides a supporting force for the collapse cavity; at step 5, after the movable support column contacts the surface of the collapse cavity, the single hydraulic prop is adjusted, and the movable support column actively provides a supporting force for the collapse cavity.

7. The method of treating tunnel collapse with a roof-contacted shield support according to claim 1, wherein at step 6, when the single hydraulic prop occupies a mounting position of the initial supporting arch, an alternative single hydraulic prop is firstly erected at a position adjacent to the single hydraulic prop, and then, the single hydraulic prop occupying the mounting position of the initial supporting arch is removed.

8. The method of treating tunnel collapse with a roof-contacted shield support according to claim 1, wherein after step 7 is completed, a load of the shield plate is transferred from the single hydraulic prop to the initial supporting arch.

9. The method of treating tunnel collapse with a roof-contacted shield support according to claim 1, wherein at step 8, the exhaust pipe protrudes to the top of the collapse cavity, and the height of an outlet of the filling material pumping pipe is less than a height of a port of the exhaust pipe; at step 9, the fast-setting concrete is sprayed onto the initial supporting arch to form a closed shell.

* * * * *